US009490059B2

(12) United States Patent
Nishio et al.

(10) Patent No.: US 9,490,059 B2
(45) Date of Patent: Nov. 8, 2016

(54) COIL COMPONENT, METHOD FOR MANUFACTURING THE SAME, AND COIL ELECTRONIC COMPONENT

(71) Applicant: Panasonic Corporation, Osaka (JP)

(72) Inventors: Shota Nishio, Osaka (JP); Nobuya Matsutani, Osaka (JP); Takeshi Takahashi, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 143 days.

(21) Appl. No.: 14/474,189

(22) Filed: Sep. 1, 2014

(65) Prior Publication Data

US 2015/0070120 A1 Mar. 12, 2015

(30) Foreign Application Priority Data

Sep. 9, 2013 (JP) ..... 2013-185873

(51) Int. Cl.

| | |
|---|---|
| ***H01F 27/08*** | (2006.01) |
| ***H01F 27/10*** | (2006.01) |
| ***H01F 27/02*** | (2006.01) |
| ***H01F 27/22*** | (2006.01) |
| ***H01F 27/24*** | (2006.01) |
| ***H01F 41/00*** | (2006.01) |

(52) U.S. Cl.

CPC ..... *H01F 27/22* (2013.01); *H01F 27/022* (2013.01); *H01F 27/025* (2013.01); *H01F 27/24* (2013.01); *H01F 41/005* (2013.01); *Y10T 29/49073* (2015.01)

(58) Field of Classification Search

CPC ..... H01F 27/22; H01F 27/025; H01F 27/24; H01F 41/005

USPC ..... 336/61, 55, 57, 58

See application file for complete search history.

(56) References Cited

U.S. PATENT DOCUMENTS

| | | | | |
|---|---|---|---|---|
| 8,680,959 | B2 * | 3/2014 | Downing | H01F 27/10 336/179 |
| 2009/0144967 | A1 * | 6/2009 | Hasu | H01F 27/2847 29/605 |
| 2012/0126928 | A1 * | 5/2012 | Yoshikawa | H01F 27/306 336/221 |
| 2012/0299678 | A1 * | 11/2012 | Inaba | H01F 37/00 336/61 |
| 2012/0313740 | A1 * | 12/2012 | Inaba | H01F 37/00 336/61 |

FOREIGN PATENT DOCUMENTS

| | | | |
|---|---|---|---|
| JP | 02-274756 | A | 11/1990 |
| JP | 2003007547 | A | 1/2003 |
| JP | 2011071485 | A | 4/2011 |
| JP | 2012209333 | A | 10/2012 |
| JP | 20122238659 | A | 12/2012 |

* cited by examiner

*Primary Examiner* — Elvin G Enad
*Assistant Examiner* — Kazi Hossain
(74) *Attorney, Agent, or Firm* — McDermott Will & Emery LLP

(57) ABSTRACT

A coil component has a wound coil, a coil magnetic body, and an exterior body. The coil magnetic body has a magnetic core inside winding of the wound coil. The exterior body covers a surface of the coil magnetic body. This coil component has a mount surface, and a thermal conductivity in a direction parallel to a surface of the exterior body is greater than a thermal conductivity in a direction perpendicular to the surface of the exterior body.

17 Claims, 5 Drawing Sheets

COIL COMPONENT, METHOD FOR MANUFACTURING THE SAME, AND COIL ELECTRONIC COMPONENT

BACKGROUND

1. Field of the Invention

The present technical field relates to a coil component having an exterior body that has an anisotropic thermal conductivity, a method for manufacturing the coil component, and a coil electronic component using the coil component.

2. Description of the Related Art

FIG. 8 is a sectional view of conventional coil component 108. Coil component 108 has coil magnetic body 103 including wound coil 102 formed by winding a wire, and magnetic body 101 disposed inside and outside wound coil 102 to form a closed magnetic circuit. Mounting substrate 105 made of metal is joined to an installation target side of coil component 108 in coil magnetic body 103. At least a part of an outer periphery of coil magnetic body 103 is covered with exterior body 104 formed of an insulating material (e.g., Unexamined Japanese Patent Publication No. 2012-238659).

SUMMARY

A coil component of the present disclosure has a wound coil, a coil magnetic body, and an exterior body. The coil magnetic body has a magnetic core inside winding of the wound coil. The exterior body covers a surface of the coil magnetic body. This coil component has a mount surface, and a thermal conductivity in a direction parallel to a surface of the exterior body is greater than a thermal conductivity in a direction perpendicular to the surface of the exterior body.

With the above configuration, this coil component allows heat generated from the coil magnetic body to be conducted preferentially to the mounting substrate through the exterior body. Hence, it is possible to suppress radiation of the heat to outside air, and to reduce an influence on other mounted components.

DETAILED DESCRIPTION OF THE PREFERRED EMBODIMENT

Figure 8:
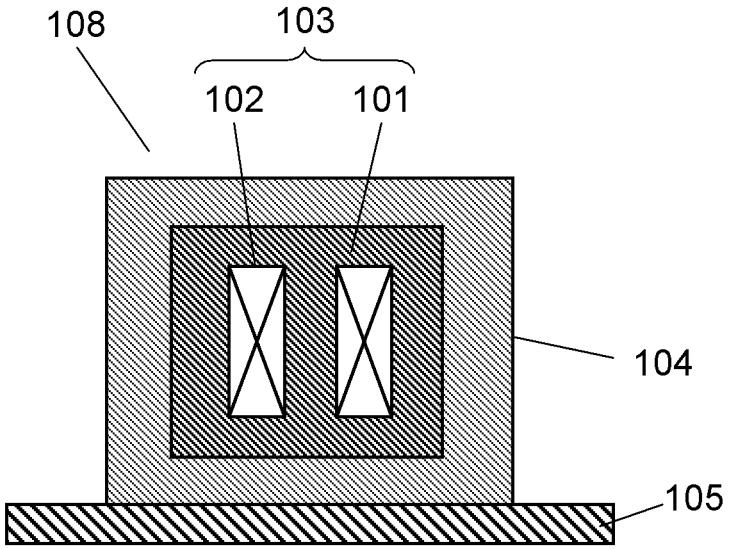
FIG. 8 PRIOR ART
FIG. 8 is a sectional view of a conventional coil component.

Prior to the description of an exemplary embodiment of the present disclosure, a problem of the conventional coil component will be briefly described. In coil component 108 illustrated in FIG. 8, coil magnetic body 103 is simply covered with exterior body 104. A thermal conductivity in exterior body 104 is normally uniform. Therefore, heat generated by passage of a current through coil component 108 is transferred through exterior body 104 and radiated to outside air. As a result, temperatures of other mounted components is increased, which may cause erroneous operations of these components.

Figure 1A:
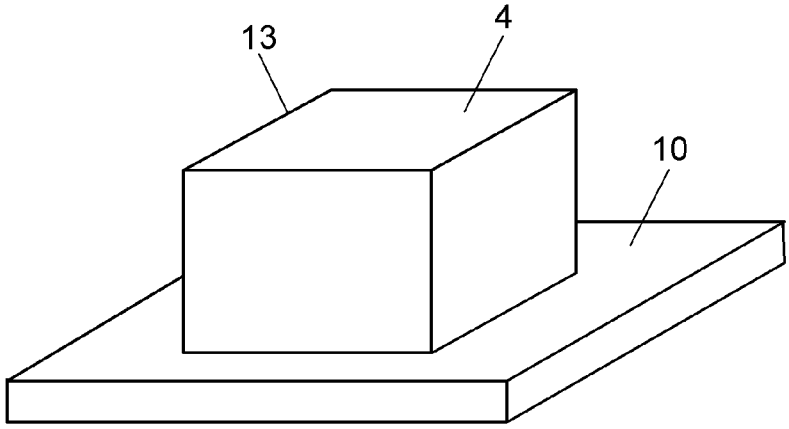
FIG. 1A is a perspective view of a coil electronic component including a coil component in an exemplary embodiment of the present disclosure.
Figure 1B:
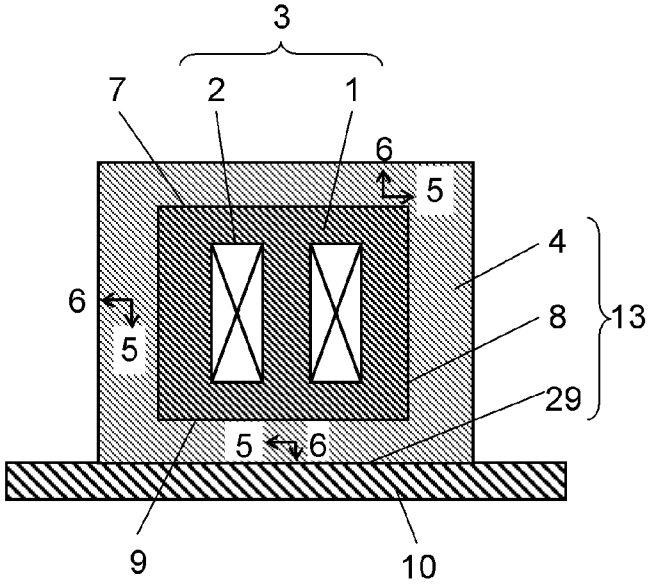
FIG. 1B is a sectional view of the coil electronic component illustrated in FIG. 1A.

Hereinafter, coil component 13 according to the exemplary embodiment of the present disclosure will be described with reference to the drawings. FIG. 1A is a perspective view of a coil electronic component including coil component 13, and FIG. 1B is a sectional view of the coil electronic component.

Coil component 13 has wound coil 2, coil magnetic body 3, and exterior body 4. Coil magnetic body 3 has a magnetic core inside winding of wound coil 2. Exterior body 4 covers a surface of coil magnetic body 3. Coil component 13 has mount surface 29, and a thermal conductivity in a direction parallel to a surface of exterior body 4, indicated by arrow 5, is greater than a thermal conductivity in a direction perpendicular to the surface of exterior body 4, indicated by arrow 6.

That is, exterior body 4 has an anisotropic thermal conductivity. The thermal conductivity in the direction parallel to the surface of exterior body 4 is greater than the thermal conductivity in the direction perpendicular to the surface of exterior body 4. Therefore, heat generated in coil magnetic body 3 is transferred preferentially in a direction toward mounting substrate 10. Hence, it is possible to suppress radiation of the heat to the outside air. As described above, by transferring the heat more preferentially to mounting substrate 10 than to the outside air, it is possible to reduce an influence by the heat on other mounted components. Although it is possible to dispose each of the components in consideration of the influence by the heat on the other mounted components, such restriction causes an increase in area of the mounting substrate and leads to an increase in product size. However, the use of coil component 13 eliminates the need for considering such a disposition.

Note that coil component 13 and mounting substrate 10 configure the coil electronic component. Coil component 13 is mounted to mounting substrate 10 at mount surface 29.

Next, magnetic body 1 will be described. Examples of a main material for magnetic body 1 include a variety of ferrite sintered bodies such as an Ni—Zn based ferrite sintered body and an Mn—Zn based ferrite sintered body, and soft magnetic metal magnetic powders such as a Fe powder, a Fe—Ni alloy powder, a Fe—Si alloy powder, a Fe—Al—Si alloy powder, an amorphous alloy powder, and a metal glass alloy powder. Magnetic body 1 is a powder magnetic core formed by molding the above material at high pressure, or a laminate formed by laminating thin plates or thin bands.

Next, wound coil 2 will be described. Examples of a raw material for wound coil 2 include metals having a small electric resistivity, such as Au, Ag, and Cu, and an alloy whose main component is any of these metals. Further, in consideration of reducing a weight of coil component 13, a light metal such as Al may be used as the main component.

An insulating film is formed on a surface of wound coil 2. This film can suppress contact between portions of the wire of wound coil 2. Alternatively, when adjacent portions of the wires are electrically insulated from each other, there is no need to provide the insulating film.

It is not limited to use just one wound coil 2, and a plurality of wound coils 2 may be used. Further, examples of a cross sectional shape of the wire of wound coil 2 include shapes of a round, a square, and a rectangular, or the cross sectional shape may be elliptical or polygonal transformed from those wire shapes. Moreover, in order to improve a withstand voltage and insulating resistance, a bobbin may be provided between magnetic body 1 and wound coil 2. In the case of using the rectangular wire as wound coil 2, a winding method is not particularly limited, and edgewise winding, flatwise winding, and the like can be applied.

A description will be given below of coil magnetic body 3 configured by wound coil 2 and magnetic body 1 that is disposed inside the winding of wound coil 2. There are a variety of shapes for coil magnetic body 3. In particular, a shape of magnetic body 1 may be a variety of variant shapes such as a toroidal shape, a U-shape, an E-shape, an I-shape, a pod shape, and a spherical shape. Further, these shapes may be combined. Moreover, for the purpose of suppressing decrease in inductance value during passage of a current through wound coil 2, a non-magnetic body or a clearance can be provided as a gap part in a part of magnetic body 1.

Next, mounting substrate 10 for mounting coil component 13 thereto will be described. A material for mounting substrate 10 is not particularly limited, and metal, ceramic, or a resin can be used, or a compound of these materials can also be used. Note that, in order to dissipate heat generated in coil component 13, it is preferable that a thermal conductivity of mounting substrate 10 be high. Further, mounting substrate 10 is preferably cooled by some configuration. For example, there can be used a technique such as water cooling by use of water or a liquid coolant such as an anti-freezing solution, or air cooling by forced air cooling or natural air cooling.

Next, exterior body 4 will be described. As illustrated in FIGS. 1A and 1B, exterior body 4 covers at least a part of an outer surface of coil magnetic body 3. With this configuration, it is possible to efficiently send the heat generated in coil magnetic body 3 to mounting substrate 10. That is, a part of the outer surface of coil magnetic body 3 may be exposed from exterior body 4. Exterior body 4 has an anisotropic thermal conductivity, and the thermal conductivity in the direction parallel to the surface of exterior body 4, indicated by arrow 5, is preferably greater than the thermal conductivity in the direction perpendicular to the surface of exterior body 4, illustrated by arrow 6.

As a raw material for exterior body 4, a resin material, a metal material, or a ceramic material can be used, or the raw material for exterior body 4 can also be formed by combining these materials. Further, exterior body 4 can be provided on the surface of coil magnetic body 3 by a method of separately preparing exterior body 4 and coil magnetic body 3 and combining exterior body 4 with coil magnetic body 3, or by a method of integrally forming exterior body 4 with coil magnetic body 3 as described below. From a viewpoint of efficiently sending the heat generated from coil magnetic body 3, it is preferable that exterior body 4 and coil magnetic body 3 be integrally formed with no gap therebetween.

A shape of coil component 13 is not particularly limited, and whole of coil magnetic body 3 may be covered with exterior body 4 as illustrated in FIGS. 1A and 1B. That is, coil magnetic body 3 has bottom surface 9 as a first surface which is closest to mount surface 29 and parallel to mount surface 29, top surface 7 as a second surface parallel to bottom surface 9, and side surface 8 as third surfaces between top surface 7 and bottom surface 9, and all of bottom surface 9, top surface 7, and side surfaces 8 may be covered with exterior body 4. Top surface 7 is opposed to bottom surface 9, and each of side surfaces 8 belongs to neither bottom surface 9 nor top surface 7.

Coil component 13 transfers the heat generated from coil magnetic body 3 preferentially to mounting substrate 10, thereby reducing radiation of the heat to the outside air. That is, a portion of exterior body 4 which is arranged on top surface 7 has an anisotropic thermal conductivity, and a thermal conductivity in the direction parallel to the surface of exterior body 4 is greater than a thermal conductivity in the direction perpendicular to this surface. Further, a configuration is preferred in which the heat is radially transferred with an any point on a top surface of exterior body 4 as a center, and the heat is then sent to mounting substrate 10 via a portion of exterior body 4 which is disposed on side surface 8. By taking a point close to a center of top surface 7 as this any point, deviation of the heat is small on the top surface of exterior body 4, and the heat can be transferred through portions along side surfaces 8 in a more uniform manner. The number of any points is preferably one for the purpose of uniformly diffusing the heat, but a plurality of any points may be present.

Further, the portion of exterior body 4 which is disposed on side surface 8 also has an anisotropic thermal conductivity, and the thermal conductivity in the direction parallel to the surface of exterior body 4 is greater than the thermal conductivity in the direction perpendicular to this surface. In other words, a thermal conductivity in the direction toward mounting substrate 10 is maximal in this portion. With this configuration, it is possible to efficiently transfer the heat generated in coil magnetic body 3 to mounting substrate 10. As a result, a heat release effect throughout coil component 13 is enhanced.

As described above, it is preferable that exterior body 4 be provided on at least top surface 7 and side surface 8, and it is further preferable that the thermal conductivity in the portion of exterior body 4 which is provided on side surface 8 is maximal in a direction in which bottom surface 9 and top surface 7 are opposed to each other. Particularly, it is further preferable that the thermal conductivity in the portion of exterior body 4 provided on side surface 8 in the direction in which bottom surface 9 and top surface 7 are opposed to each other be maximal throughout exterior body 4.

In the configuration illustrated in FIG. 1B, exterior body 4 is arranged also on bottom surface 9. Since a portion of exterior body 4 on bottom surface 9 is not in contact with the outside air, the portion does not exert the effect of reducing radiation of the heat to the outside air. This portion serves to transfer, to mounting substrate 10, the heat transferred from coil magnetic body 3 or from the portion of exterior body 4 provided on side surface 8. It is thus preferable that a thermal conductivity in a direction perpendicular to bottom surface 9 of coil magnetic body 3 and mount surface 29 be maximal. However, even when exterior body 4 is disposed on bottom surface 9, and this portion of exterior body 4 also has a high anisotropic thermal conductivity in a direction parallel to mount surface 29, it is sufficiently possible to obtain the effect of the present disclosure.

Figure 2:
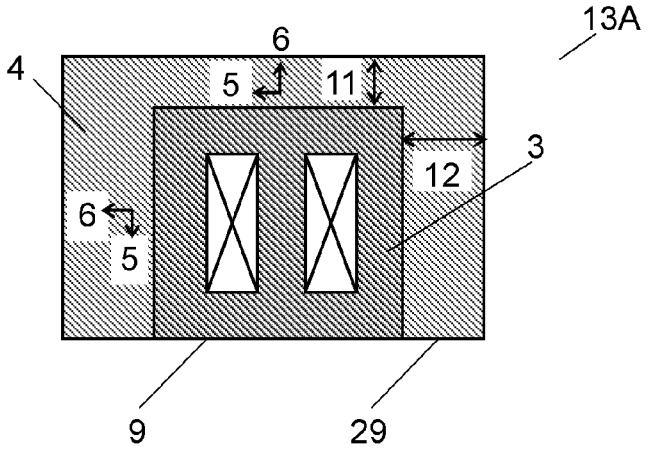
FIG. 2 is a sectional view of another coil component in the exemplary embodiment of the present disclosure.
Figure 3:
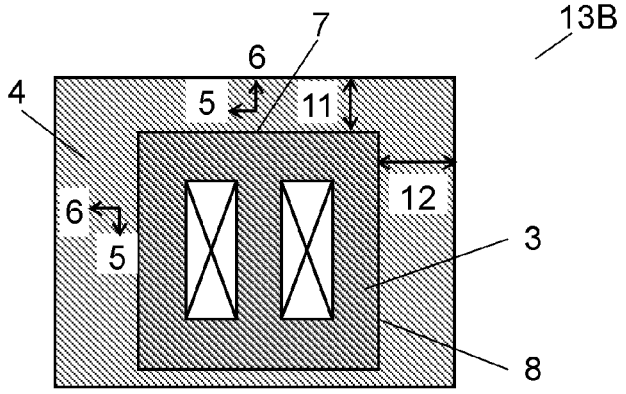
FIG. 3 is a sectional view of still another coil component in the exemplary embodiment of the present disclosure.
Figure 4:
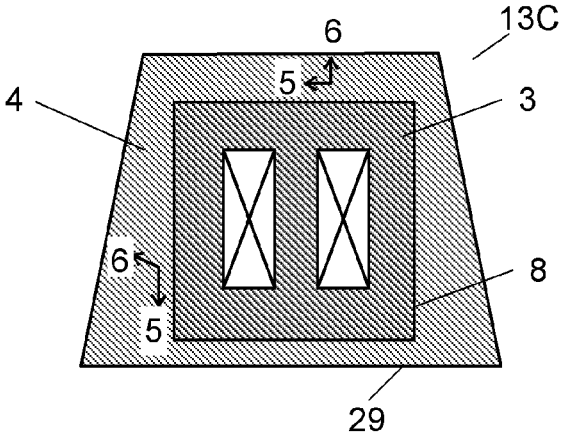
FIG. 4 is a sectional view of further another coil component in the exemplary embodiment of the present disclosure.

Next, modified examples of the coil component according to the exemplary embodiment will be described with reference to FIGS. 2 to 4. FIGS. 2 to 4 are respective sectional views of coil components 13A to 13C in the exemplary embodiment of the present disclosure.

In coil component 13A illustrated in FIG. 2, exterior body 4 is not provided on bottom surface 9 of coil magnetic body 3, and bottom surface 9 constitutes a part of mount surface 29. In this case, bottom surface 9 is the first surface which is closest to mount surface 29, and identical to mount surface 29.

In coil component 13B illustrated in FIG. 3, thickness 12 of the portion of exterior body 4 which is provided on side surface 8 is larger than thickness 11 of the portion of exterior body 4 which is provided on top surface 7. With this configuration, it is possible to selectively reduce a temperature rise on side surface 8. This leads to an increase in temperature difference between the portion of exterior body 4 on top surface 7 and the portion of exterior body 4 on side surface 8. As a result, it is possible to more effectively promote transfer of the heat from the portion of exterior body 4 on top surface 7 to the portion of exterior body 4 on side surface 8.

In coil component 13C illustrated in FIG. 4, the portion of exterior body 4 which is provided on side surface 8 becomes greater in thickness as approaching mount surface 29. With this configuration, the heat release effect becomes more remarkable, thus the configuration is preferable. Even when an entire thickness of exterior body 4 is made large, it is possible to promote transfer of the heat to mounting substrate 10. In such a configuration, however, a volume of coil component 13 becomes large. Therefore, from the viewpoint of achieving both size reduction and heat dissipation of coil component 13C, the configuration described above is particularly useful.

Figure 5A:
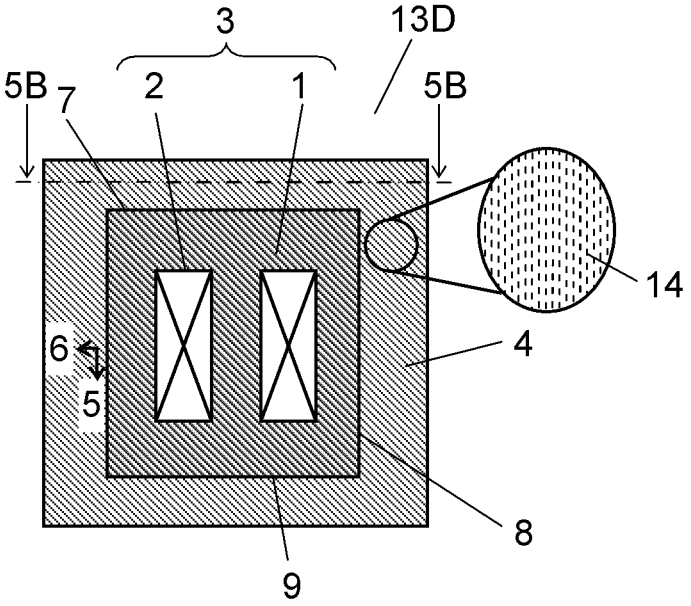
FIG. 5A is a sectional view of a coil component in the exemplary embodiment of the present disclosure.
Figure 5B:
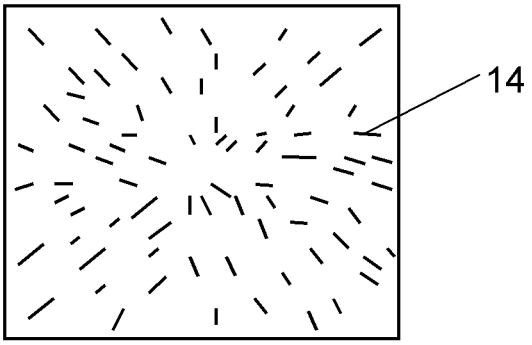
FIG. 5B is a sectional view of the coil component illustrated in FIG. 5A taken along line 5B-5B.

Next, a specific configuration to impart anisotropy to the thermal conductivity of exterior body 4 will be described. As such a specific method, there are a method in which exterior body 4 is formed of a liquid crystal polymer, and a method in which exterior body 4 is formed of a resin and an inorganic filler. First, the former method will be described with reference to FIGS. 5A and 5B. FIG. 5A is a sectional view of coil component 13D in the exemplary embodiment of the present disclosure. FIG. 5B is a sectional view of coil component 13D taken along line 5B-5B.

In coil component 13D, exterior body 4 is formed of a liquid crystal polymer. Molecules 14 of the liquid crystal polymer are oriented along the surface of exterior body 4. Molecules 14 of the liquid crystal polymer in a molten state have a property of being oriented in a flowing direction. Therefore, injection-molding the liquid crystal polymer on the surface of coil magnetic body 3 allows molecules 14 to be oriented along the surface of exterior body 4. With such orientation of molecules 14, it is possible to allow exterior body 4 to have the anisotropic thermal conductivity. Specifically, the thermal conductivity in the direction parallel to the surface of exterior body 4, indicated by arrow 5, is greater than the thermal conductivity in the direction perpendicular to the surface of exterior body 4, indicated by arrow 6.

For example, coil magnetic body 3 is disposed in a mold, and the liquid crystal polymer in the molten state is poured into a gap between the mold and coil magnetic body 3. At this time, orientation of molecules 14 can be controlled by appropriately adjusting a structure of the mold, a position or an angle of an inlet for the liquid crystal polymer, pressure or a quantity of the poured liquid crystal polymer, or the like. The clearance between coil magnetic body 3 and the mold is preferably not less than 0.2 mm and not more than 30 mm. By making the clearance between coil magnetic body 3 and the mold not less than 0.2 mm, it is possible to inject the liquid crystal polymer in the molten state into this clearance with good fluidity. Meanwhile, by making the clearance not more than 30 mm, it is possible to effectively orient molecules 14 in the direction of an outer surface of exterior body 4 and to impart the anisotropy to the thermal conductivity. As described above, when forming exterior body 4, the gap between coil magnetic body 3 and a wall surface of the mold can be filled with the liquid crystal polymer in the molten state by injection molding, and the liquid crystal polymer can be cured such that molecules 14 of the liquid crystal polymer are oriented along the surface of exterior body 4.

Generally, the liquid crystal polymer is categorized, in terms of its structure, into a main-chain liquid crystal polymer, a side-chain liquid crystal polymer, a complex liquid crystal polymer, and the like. The liquid crystal polymer in the present disclosure is not particularly limited, and any of the above liquid crystal polymers can be used.

Further, as illustrated in FIG. 5B, in order to transfer the heat radially from the any point in the portion of exterior body 4 which is provided on top surface 7, the liquid crystal polymer in the molten state is preferably caused to flow from this any point. In such a manner, by providing the inlet for pouring the liquid crystal polymer into the mold at one place that is opposed to top surface 7, molecules 14 are radially oriented on top surface 7. Further, by the liquid crystal polymer further flowing along side surface 8, molecules 14 are oriented on side surface 8 along the surface of exterior body 4. Hence, it is more preferable to provide the inlet at a position opposed to a central part of top surface 7.

Moreover, by making the clearance between coil magnetic body 3 and the mold not less than 0.5 mm and not more than 20 mm, and further, not less than 0.8 mm and not more than 15 mm, it is possible to allow the liquid crystal polymer in the molten state to have good fluidity, and to form exterior body 4 having an anisotropic thermal conductivity. Note that, if a resin whose molecules or the like have orientation properties is used, anisotropy can be imparted to a thermal conductivity in a manner similar to the above. By using the liquid crystal polymer with an excellent anisotropic thermal conductivity among such resins, the configuration of the present disclosure can be effectively realized.

Figure 6:
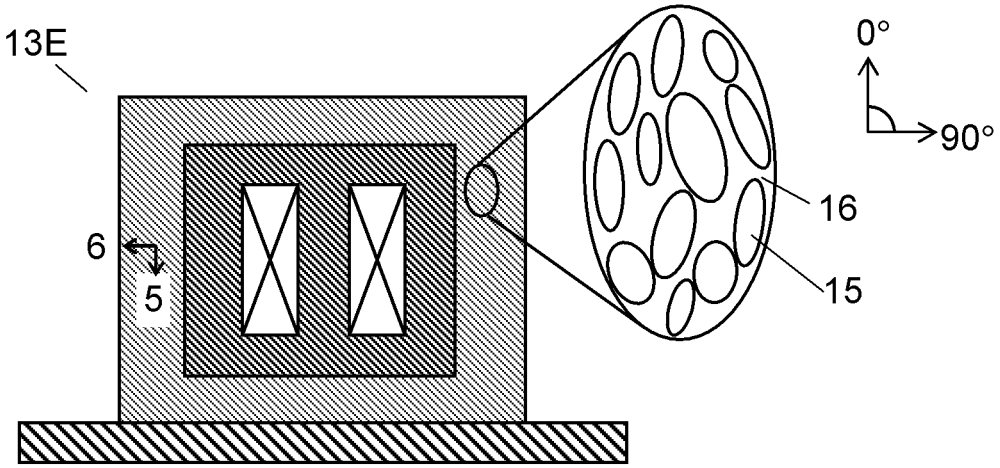
FIG. 6 is a sectional view of a coil component in the exemplary embodiment of the present disclosure.

Next, another technique for allowing exterior body 4 to have the anisotropy in the thermal conductivity will be described with reference to FIG. 6. FIG. 6 is a sectional view of coil component 13E in the exemplary embodiment of the present disclosure.

In coil component 13E, exterior body 4 contains resin 16 and the inorganic filler. The inorganic filler is contained in resin 16, and is made of a plurality of particles 15 each having a long axis and a short axis shorter than the long axis. An aspect ratio of the long axis and the short axis of particle 15 is larger than 1. A quantity (number) of particles 15, in each of which an angle formed by an extending direction of the long axis and the direction parallel to the surface of exterior body 4 is not less than 0° and less than 45°, is larger than a quantity (number) of particles 15, in each of which the angle is not less than 45° and not more than 90°, per unit volume of exterior body 4. With this configuration, the thermal conductivity in the direction parallel to the surface of exterior body 4, indicated by arrow 5, is greater than the thermal conductivity in the direction perpendicular to the surface of exterior body 4, indicated by arrow 6.

For realizing this configuration, for example, a mixture of resin 16 in a flowable state such as a molten state and an uncured state and particles 15 may be injection-molded in a manner similar to the example of the liquid crystal polymer described above. Further, the clearance between coil magnetic body 3 and the mold at that time is preferably not less than 0.3 mm and not more than 25 mm. When the clearance between coil magnetic body 3 and the mold is not less than 0.3 mm, it is possible to readily inject the mixture of resin 16 in the flowable state and particles 15 into this gap. Meanwhile, when the clearance is not more than 25 mm, it is possible to effectively orient the extending direction of the long axis of particles 15 in the direction parallel to the surface of exterior body 4, and to allow exterior body 4 to have the anisotropic thermal conductivity.

In this manner, when forming exterior body 4, the gap between coil magnetic body 3 and the wall surface of the mold is filled by injection molding with the mixture of uncured resin 16 and the plurality of particles 15 of the inorganic filler. It is thereby possible to cure resin 16 such that, the number of particles 15 of the inorganic filler, in each of which the angle formed by the extending direction of the long axis and the direction parallel to the surface of exterior body 4 is not less than 0° and less than 45°, is larger than the number of particles 15 of the inorganic filler, in each of which the angle is not less than 45° and not more than 90°, per unit volume of exterior body 4. Further, by making the clearance between coil magnetic body 3 and the mold to be not less than 0.5 mm and not more than 20 mm, and further, not less than 1 mm and not more than 15 mm, it is possible to allow resin 16 in the molten state to have good fluidity. Then, the quantity of particles 15 per unit volume, each of which having an aspect ratio larger than 1 and in each of which the angle formed by the direction of the long axis and the direction along the outer surface of exterior body 4 is not less than 0° and less than 45°, can be made still larger than the quantity of particles 15 per unit volume, in each of which the angle is not less than 45° and not more than 90°. This allows formation of exterior body 4 having a more anisotropic thermal conductivity in the direction parallel to the surface.

Examples of a material for resin 16 include a thermosetting resin and a thermoplastic resin. Further, examples of the inorganic filler include a variety of oxides such as alumina, mica, talc, kaolin, and silica, a variety of nitrides such as boron nitride and silicon nitride, glass, and graphite. Moreover, particle 15 may have any shape with an aspect ratio of a long axis and a short axis being larger than 1, preferably not less than 5, and specific examples of the shape include a scale shape, a fiber shape, and a spheroid shape.

Furthermore, exterior body 4 is not limited to a material or the like if exterior body 4 has an anisotropic thermal conductivity and if, among these thermal conductivities, the thermal conductivity in the direction parallel to the surface of exterior body 4 is greater than the thermal conductivity in the direction perpendicular to the surface. However, the most preferable example is a method in which exterior body 4 is formed of the liquid crystal polymer or formed of the mixture of the resin and the inorganic filler made of particles 15 each having an aspect ratio larger than 1, as described above.

As described above, in the method for manufacturing the coil component according to the present exemplary embodiment, firstly, wound coil 2 and coil magnetic body 3 having the magnetic core are disposed inside the mold having the wall surface such that the magnetic core of coil magnetic body 3 is located inside the winding of wound coil 2. Next, exterior body 4 that covers the surface of coil magnetic body 3 is formed such that the thermal conductivity in the direction parallel to the surface of exterior body 4 is greater than the thermal conductivity in the direction perpendicular to the surface of exterior body 4.

Note that the direction in which the long axis of molecule 14 of the liquid crystal polymer or the long axis of particle 15 of the inorganic filler extends can be measured by tissue observation of the surface and the cross section of exterior body 4 or by a variety of methods such as X-ray diffraction and Raman spectroscopy.

Hereinafter, the method for manufacturing the coil component according to the present exemplary embodiment will be described in detail by use of specific examples. Note that the present disclosure is not limited to the following examples.

Figure 7:
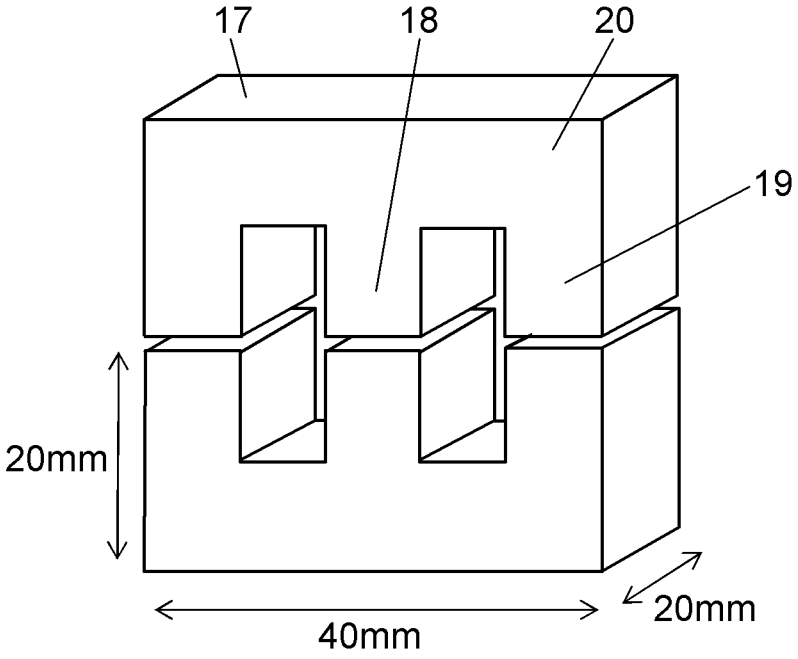
FIG. 7 is a perspective view of a coil magnetic body in the exemplary embodiment of the present disclosure.

First, a mixed powder prepared by mixing a Fe—Si alloy powder and a silicone resin is press-molded with a molding pressure of 10 ton/cm$^2$, to prepare an E-shaped molded body. Subsequently, this E-shaped molded body is thermally treated at 500° C., to form E-shaped magnetic body 17. FIG. 7 is a perspective view of E-shaped magnetic body 17 as the coil magnetic body in the exemplary embodiment of the present disclosure.

E-shaped magnetic body 17 has middle magnetic leg 18, two outer magnetic legs 19, and rear magnetic body 20. Middle magnetic leg 18 is located at a center of E-shaped magnetic body 17, and outer magnetic legs 19 are located on both sides of middle magnetic leg 18. Rear magnetic body 20 connects middle magnetic leg 18 and outer magnetic leg 19 together.

Two E-shaped magnetic bodies 17 having the shape as described above are prepared, and the respective three magnetic legs are abutted so as to be opposed to each other as illustrated in FIG. 7. Then, one wound coil 2 formed by winding a round wire having a diameter of 1 mm with 30 turns is inserted into middle magnetic leg 18, to form coil magnetic body 3. A length of rear magnetic body 20 is 40 mm, a length of two E-shaped molded bodies 17 in a direction parallel to middle magnetic leg 18 is 40 mm, and a length in a direction perpendicular to a direction of the length of rear magnetic body 20 and a direction parallel to middle magnetic leg 18 is 20 mm (40 mm×40 mm×20 mm).

The coil magnetic body as thus formed is placed inside a mold. A bottom surface inside this mold is a substantially square with a side of 42 mm, and a surface of 40 mm×40 mm in the coil magnetic body is disposed so as to face the bottom surface. That is, the height of the coil magnetic body with respect to this bottom surface is 20 mm. A height inside this mold is 22 mm. Hence, the coil magnetic body is placed with a 1-mm gap provided between an inner surface of the mold and each of a top surface, side surfaces, and a bottom surface of the coil magnetic body. In this case, the exterior body is formed on each of the top surface, the side surfaces, and the bottom surface of the coil magnetic body, with a thickness of 1 mm. By positioning the coil magnetic body with a pin or the like, the coil magnetic body can be placed more accurately inside the mold.

Each of tips of terminals of the wound coil is drawn from a hole provided in the mold to the outside of the space. This portion becomes a connection electrode with an external circuit.

Next, Table 1 shows results of measuring heat generation characteristics obtained from materials for the exterior body and with methods for molding the exterior body.

TABLE 1

| | Material forming exterior body | | Exterior body | Orientation direction of liquid crystal polymer molecules and inorganic filler particles on each surface | | | Space |
|---|---|---|---|---|---|---|---|
| Sample No. | Resin | Inorganic filler | molding method | Top surface | Side surface | Bottom surface | temperature ° C. |
| 1 | aromatic polyester | none | injection molding | direction along top surface | direction along side surface | direction along bottom surface | 35 |
| 2 | aromatic polyester | none | injection molding | radial direction from middle point of top surface | direction toward bottom surface | radial direction from middle point of top surface | 26 |
| 3 | epoxy | boron nitride powder | injection molding | direction along top surface | direction along side surface | direction along bottom surface | 33 |
| 4 | epoxy | boron nitride powder | injection molding | radial direction from middle point of top surface | direction toward bottom surface | radial direction from middle point of top surface | 25 |
| 5 | aromatic polyester | boron nitride powder | injection molding | direction along top surface | direction along side surface | direction along bottom surface | 29 |
| 6 | aromatic polyester | boron nitride powder | injection molding | radial direction from middle point of top surface | direction toward bottom surface | radial direction from middle point of top surface | 22 |
| 7 | epoxy | none | injection molding | not oriented | not oriented | not oriented | 57 |
| 8 | epoxy | spherical silica powder | injection molding | not oriented | not oriented | not oriented | 60 |
| 9 | aromatic polyester | none | potting | not oriented | not oriented | not oriented | 59 |
| 10 | epoxy | boron nitride powder | potting | not oriented | not oriented | not oriented | 62 |

As shown in Table 1, in Samples No. 1, 2, 5, 6, and 9, an aromatic polyester resin that is a thermoplastic liquid crystal polymer is used for the exterior body, and in Samples No. 3, 4, 7, 8, and 10, an epoxy resin that is a thermosetting resin is used.

In Samples No. 3, 4, 5, 6, and 10, 5 wt % of a scale-shaped boron nitride powder with an average aspect of 20 as the inorganic filler is mixed with the epoxy resin or the aromatic polyester resin, to be used as a material for the exterior body. In Sample No. 8, 5 wt % of a spherically shaped silicon nitride powder with an average aspect ratio of 1 is mixed with the epoxy resin, to be used as the material for the exterior body.

As to Samples No. 1 to 8, the exterior body is formed by injection-molding the above materials. Conditions for injection are as follows. In the case of the aromatic polyester resin, a cylinder temperature is 300° C., a mold temperature during molding is 130° C., and injection pressure is 40 MPa. In the case of the epoxy resin, a cylinder temperature is 175° C., a mold temperature during molding is 170° C., and injection pressure is 10 MPa.

Note that the injection molding in the present disclosure refers to a general molding method of pressurizing a material with fluidity to supply the material into the mold for molding, and this method includes a variety of molding methods such as transfer molding.

In any of Samples No. 1 to 8, an inlet for pouring the material for the exterior body into the mold is provided at one place opposed to the coil magnetic body. In Samples No. 1, 3, and 5, the inlet is provided on a side surface of the mold which is opposed to the side surface of the coil magnetic body, and in Samples No. 2, 4, 6, 7, and 8, the inlet is provided on a top surface of the mold which is opposed to the top surface of the coil magnetic body.

Meanwhile, in Samples No. 9 and 10, the exterior body is formed by resin potting. That is, a ceiling block forming a substantially parallelepiped space provided inside the mold is removed and a material heated and brought into a flowing state is poured into the mold, to form the exterior body.

In any of Samples No. 1 to 10, after injection molding or potting, coil magnetic body 3 is left inside the mold until the material to form the exterior body is cured, and after the exterior body is sufficiently cured, a coil component integrally formed of the coil magnetic body and the exterior body is taken out of the mold. Note that, as to sample No. 10, the mold is heated to 175° C. after potting to perform curing treatment so that the epoxy resin as the thermosetting resin is cured.

Next, results of evaluating heat generation characteristics of Samples No. 1 to 10 will be described. A space calorific value is measured on the following conditions. That is, an aluminum substrate of 150 mm×150 mm×5 mm is used as the mounting substrate, and the coil component is installed such that a mount surface that is a bottom surface of the exterior body makes contact with a top surface of the mounting substrate. Further, the mounting substrate is cooled by water with a temperature of 20° C.

Subsequently, the sample mounted on the mounting substrate is enclosed by an enclosure forming a stereoscopic space of 150 mm×150 mm×150 mm. As this enclosure, a wooden enclosure having sufficient heat insulation is used, so as to block entry/exit of a gas inside/outside the space. For measuring a temperature inside the cubic space, thermocouples are installed at eight points of corners inside the cubic space. Note that an outside air temperature is controlled to be 20° C.

Subsequently, a 100-A direct current is allowed to flow through the wound coil of the coil component from a power source connected to the wound coil. By passage of the current through the wound coil, the coil magnetic body generates heat due to a loss and the heat is dissipated to the space and the mounting substrate. At this time, a temperature inside the space increases with time, but when certain time elapses, each region reaches thermal equilibrium, and a temperature in each region shows a substantially constant value. An average value of the temperatures in the air, measured at the eight points of the corners inside the cubic space, is recorded as a space temperature.

As shown in Table 1, in Samples No. 1 to 6, it has been observed that in any of the exterior bodies, molecules of the aromatic polyester resin, particles of the boron nitride powder, or both the molecules and particles are oriented in the direction along the surface of the exterior body. A value of the space temperature is from 22° C. to 35° C., and a temperature rise is small.

In contrast, in Samples No. 7, 8, 9, and 10, orientation in the exterior body is not observed, the space temperature is from 57° C. to 62° C., and the temperature rise is significant.

In Samples No. 1, 3, and 5, the material for the exterior body is injected from a side surface of the coil component. For this reason, on this side surface, the molecules of the aromatic polyester resin or the particles of the boron nitride powder are radially oriented from a point where the injection has been performed. Further, on other surfaces (two surfaces adjacent to the side surface where the material for the exterior body has been injected, among a top surface, a bottom surface, and three remaining side surfaces), the molecules or the particles are oriented toward the side surface on the rear side of the side surface where the material for the exterior body has been injected.

In Samples No. 2, 4, and 6, the material for the exterior body is injected from the top surface of the coil component. For this reason, on this top surface, the molecules of the aromatic polyester resin or the particles of the boron nitride powder are radially oriented from a point where the injection has been performed. Further, on the four side surfaces, the molecules or the particles are oriented toward the bottom surface. Due to such orientation, heat generated in the coil magnetic body is transferred preferentially to the mounting substrate through the side surfaces of the exterior body. Therefore, the temperature rise of the space temperature is small as compared to those in Samples No. 1, 3, and 5.

In Sample No. 2, orientation of the molecules of the aromatic polyester resin is suitable in the exterior body, and in Sample No. 4, orientation of the particles of boron nitride with an aspect ratio of approximately 20 is suitable in the exterior body. Therefore, the temperature rise is small, and it is found that most of the heat generated in the coil magnetic body is not radiated to the space but transferred preferentially to the mounting substrate. Further, in Sample No. 6, portions of the exterior body which are provided on the top surface and all the side surfaces of the coil magnetic body contain the molecules of the aromatic polyester resin and the particles of boron nitride each having an aspect ratio of approximately 20, and these molecules and particles are all oriented in the direction toward the bottom surface. Therefore, the temperature rise is especially small, and it is found that most of the heat generated in the coil magnetic body is not radiated to the space but transferred preferentially to the mounting substrate.

Meanwhile, in Sample No. 8, a spherically shaped silica powder made of particles with an aspect ratio of 1 is used as the inorganic filler. As shown in Table 1, the space temperature in Sample No. 8 is very high as compared to those in Samples No. 3, 4, 5, and 6.

That is, it is found that by the exterior body containing the inorganic filler, the inorganic filler contributes to transfer of the heat generated from the coil magnetic body, but when the aspect ratio is not larger than 1, the effect of suppressing heat radiation to the space by transferring the heat preferentially to the mounting substrate is not exerted.

Note that the inorganic filler generally has a greater thermal conductivity than that of the resin. By mixing a larger amount of the inorganic filler made of particles with an aspect ratio larger than 1 and orienting the particles, the heat generated in the coil magnetic body can be effectively transferred to the mounting substrate, which is preferable.

As described above, the coil component, the method for manufacturing the coil component, and the coil electronic component according to the present disclosure are each useful because of an excellent productivity and a significant heat dissipation. Hence, it is possible to provide an inductance component having high reliability.

What is claimed is:

1. A coil component comprising:

a wound coil;

a coil magnetic body having a magnetic core inside winding of the wound coil; and an exterior body covering a surface of the coil magnetic body and having a mount surface, wherein a thermal conductivity in a direction parallel to a surface of the exterior body is greater than a thermal conductivity in a direction perpendicular to the surface of the exterior body.

2. The coil component according to claim 1, wherein the coil magnetic body has a first surface which is closest to the mount surface and identical or parallel to the mount surface, a second surface parallel to the first surface, and a third surface between the first and second surfaces, and the exterior body is provided on at least the second and third surfaces.

3. The coil component according to claim 2, wherein a thermal conductivity of the exterior body on the third surface is maximal in a direction in which the first surface and the second surface are opposed to each other.

4. The coil component according to claim 2, wherein the exterior body is thicker on the third surface than on the second surface.

5. The coil component according to claim 2, wherein the exterior body becomes greater in thickness on the third surface as approaching the first surface.

6. The coil component according to claim 1, wherein the exterior body contains liquid crystal polymer molecules, and the liquid crystal polymer molecules are oriented along the surface of the exterior body.

7. The coil component according to claim 6, wherein the coil magnetic body has a first surface which is closest to the mount surface and identical or parallel to the mount surface, a second surface parallel to the first surface, and a third surface between the first and second surfaces, and the exterior body is provided on at least the second and third surfaces.

8. The coil component according to claim 7, wherein in the exterior body on the second surface, the liquid crystal polymer molecules are radially oriented from an any point on the second surface.

9. The coil component according to claim 7, wherein in the exterior body on the third surface, the liquid crystal polymer molecules are oriented most in a direction in which the first surface and the second surface are opposed to each other.

10. The coil component according to claim 1, wherein the exterior body includes a resin, and a plurality of particles of an inorganic filler which are contained in the resin, each of which has a long axis and a short axis shorter than the long axis, an aspect ratio of the inorganic filler particles is larger than 1, and a quantity of the inorganic filler particles, in each of which an angle formed by an extending direction of the long axis and a direction parallel to the surface of the exterior body is not less than 0° and less than 45°, is larger than a quantity of the inorganic filler particles, in each of which the angle is not less than 45° and not more than 90°, per unit volume of the exterior body.

11. The coil component according to claim 10, wherein the coil magnetic body has a first surface which is closest to the mount surface and identical or parallel to the mount surface, a second surface parallel to the first surface, and a third surface between the first and second surfaces, and the exterior body is provided on at least the second and third surfaces.

12. The coil component according to claim 11, wherein in the inorganic filler particles contained in the exterior body on the third surface, a number of the inorganic filler particles, in each of which an angle formed by an extending direction of the long axis and a direction in which the first surface and the second surface are opposed to each other is not less than 0° and less than 45°, is larger than a number of the inorganic filler particles, in each of which the angle not less than 45° and not more than 90°, per unit volume of the exterior body.

13. The coil component according to claim 11, wherein each of the inorganic filler particles contained in the exterior body on the second surface has the long axis oriented to be radial from an any point on the second surface.

14. A coil electronic component comprising:

a coil component including:

a wound coil, a coil magnetic body having a magnetic core inside winding of the wound coil, an exterior body covering a surface of the coil magnetic body, and a mount surface, wherein a thermal conductivity of the coil component in a direction parallel to a surface of the exterior body is greater than a thermal conductivity in a direction perpendicular to the surface of the exterior body; and a mounting substrate to which the coil component is mounted at the mount surface.

15. The coil electronic component according to claim 14, wherein the coil magnetic body has a first surface which is closest to the mount surface and identical or parallel to the mount surface, a second surface parallel to the first surface, and a third surface between the first and second surfaces, the exterior body is provided on at least the second and third surfaces, and a thermal conductivity of the exterior body is maximal on the third surface in a direction toward the mounting substrate.

16. The coil electronic component according to claim 15, wherein the exterior body contains liquid crystal polymer molecules, and in the exterior body on the third surface, the liquid crystal polymer molecules are oriented most in the direction toward the mounting substrate.

17. The coil electronic component according to claim 15, wherein the exterior body includes a resin, and a plurality of particles of an inorganic filler which are contained in the resin, each of which has a long axis and a short axis shorter than the long axis, an aspect ratio of the inorganic filler particles is larger than 1, and in the portion of the exterior body which is provided on the third surface, a number of the inorganic filler particles, in each of which an angle formed by an extending direction of the long axis and a direction parallel to the surface of the exterior body is not less than 0° and less than 45°, is larger than a number of the inorganic filler particles, in each of which the angle is not less than 45° and not more than 90°, per unit volume of the exterior body.

* * * * *